United States Patent [19]

Cole, Jr.

[11] Patent Number: 5,040,778

[45] Date of Patent: Aug. 20, 1991

[54] APPARATUS FOR AUTOMATICALLY INVERTING WORKPIECES OF LIMP SHEET MATERIAL

[75] Inventor: William R. Cole, Jr., Shelbyville, Tenn.

[73] Assignee: ARK, Inc., Shelbyville, Tenn.

[21] Appl. No.: 553,993

[22] Filed: Jul. 16, 1990

[51] Int. Cl.[5] ..... B65H 29/66

[52] U.S. Cl. ..... 271/65; 271/18.3; 271/186; 271/198; 198/403; 198/380

[58] Field of Search ..... 271/18.3, 65, 184, 185, 271/186, 198, 175; 198/402, 403, 404, 410, 380; 223/43

[56] References Cited

U.S. PATENT DOCUMENTS

| | | | |
|---|---|---|---|
| 3,034,632 | 5/1962 | Wampler | 198/33 |
| 3,198,513 | 8/1965 | Farez | 271/65 |
| 3,355,165 | 11/1967 | Southwell et al. | 271/65 X |
| 3,370,849 | 2/1968 | Martin | 271/68 |
| 3,549,145 | 12/1970 | Trautmann | 271/184 |
| 3,603,587 | 9/1971 | Van Dorst | 271/65 |
| 4,020,941 | 5/1977 | Kennedy | 198/402 |
| 4,027,580 | 6/1977 | Sundin | 93/93 |
| 4,175,655 | 11/1979 | Baldwin | 198/403 |
| 4,583,727 | 4/1986 | Fort | 271/19 |

*Primary Examiner*—H. Grant Skaggs

*Assistant Examiner*—C. Druzbick

*Attorney, Agent, or Firm*—Senniger, Powers, Leavitt & Roedel

[57] ABSTRACT

Apparatus is disclosed for automatically inverting workpieces of limp sheet material, such as fabric sheet material. The apparatus includes an endless conveyor having a forward-traveling upper reach for conveying workpieces in a forward direction. A gripper grasps a portion of the workpiece adjacent its leading edge as the workpiece travels on the conveyor, and lifts the leading edge portion of the workpiece off the conveyor. The gripper holds the leading edge portion stationary with a trailing portion of the workpiece extending downwardly from said pick-up means. A pushing mechanism acting on a generally rearwardly facing surface of the trailing portion of the workpiece pushes the trailing portion forwardly to effect complete inversion of the trailing portion as the leading edge portion is held stationary by the gripper. The gripper releases the leading edge portion of the workpiece after the trailing portion of the workpiece has been inverted. The leading edge of the workpiece drops to the conveyor so that the trailing edge of the workpiece leads the remaining portions of the workpiece and the leading edge trails the remaining portions of the workpiece.

20 Claims, 5 Drawing Sheets

APPARATUS FOR AUTOMATICALLY INVERTING WORKPIECES OF LIMP SHEET MATERIAL

The U.S. Government has a paid-up license in this invention and the right in limited circumstances to require the patent owner to license others on reasonable terms as provided for by the terms of contract No. DLA 900-87-C-0509 awarded by the Department of Defense.

BRIEF SUMMARY OF THE INVENTION

This invention relates to apparatus for inverting workpieces and more particularly to apparatus for automatically inverting workpieces of limp sheet material, such as fabric sheet material, as they are moved in a forward direction on a conveyor.

A common method of cutting fabric workpieces or "plies" for manufacturing articles of apparel results in the production of stacks of plies in each of which the plies are positioned with the outer surface of the fabric alternately facing up and down. More particularly, the method involves "fan-folding" a roll of fabric onto a cutting table by passing the roll back and forth across the table while letting out fabric onto the table to form the spread. The pattern for the ply required (e.g., for producing a shirt collar) is placed on the top surface of the spread, and the spread is cut through all of its layers resulting in a stack of plies.

For purposes of later manipulation of the plies, such as sewing, it is necessary that every other ply be turned so that the same surface (i.e., outer surface) of the fabric faces upward. This task may be carried out by hand; however it is very tedious for the worker and not particularly cost efficient. One solution is to carry out the task with automatic machinery. However, because the plies are of limp sheet material, it is difficult to turn them over with automatic machinery without inadvertently folding over an edge of the sheet of material. In order to carry out operations on the ply with other automatic machinery, such as an automatic sewing machine, the plies must lie completely flat and unfolded when they reach the sewing work station. Further, it is desirable to perform the inversion of the plies as they are being transported to or from a work station, such as on a conveyor. Thus, there is presently a need for apparatus which can automatically turn over plies of limp material, without folding the plies, as they travel on a conveyor.

Among the several objects of the present invention may be noted the provision of apparatus for automatically and efficiently inverting workpieces, and more particularly for automatically and efficiently inverting plies of limp fabric sheet material as they are fed to apparatus such as a sewing machine for operating on the workpiece; the provision of such apparatus which inverts the plies traveling forwardly on a conveyor; and the provision of such apparatus which effects complete inversion of a workpiece so that it lies flat and unfolded on the conveyor after inversion thereof.

In general, apparatus of this invention is designed for automatically inverting workpieces of limp sheet material, such as fabric sheet material. The apparatus comprises an endless conveyor having a forward-traveling upper reach for conveying workpieces in a forward direction. Each workpiece riding on the conveyor has a leading edge and a trailing edge. Pick-up means is provided for grasping a portion of the workpiece adjacent its leading edge as the workpiece travels on the conveyor, lifting the leading edge portion of the workpiece off the conveyor, and holding the leading edge portion stationary. A trailing portion of the workpiece extends downwardly from the pick-up means. The trailing portion contacts the conveyor and tends to move forwardly thereon beneath the leading edge portion toward an inverted position. Pusher means adapted to act on a surface of the trailing portion of the workpiece facing generally rearwardly pushes the trailing portion of the workpiece forwardly to effect complete inversion of the trailing portion as the leading edge portion is held stationary by the pick-up means. The pick-up means is adapted to release the leading edge portion of the workpiece after the trailing portion of the workpiece has been inverted. The leading edge of the workpiece is adapted to drop to the conveyor after it is released by the pick-up means with the workpiece inverted and in a position wherein the leading edge is rearward of the trailing edge.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
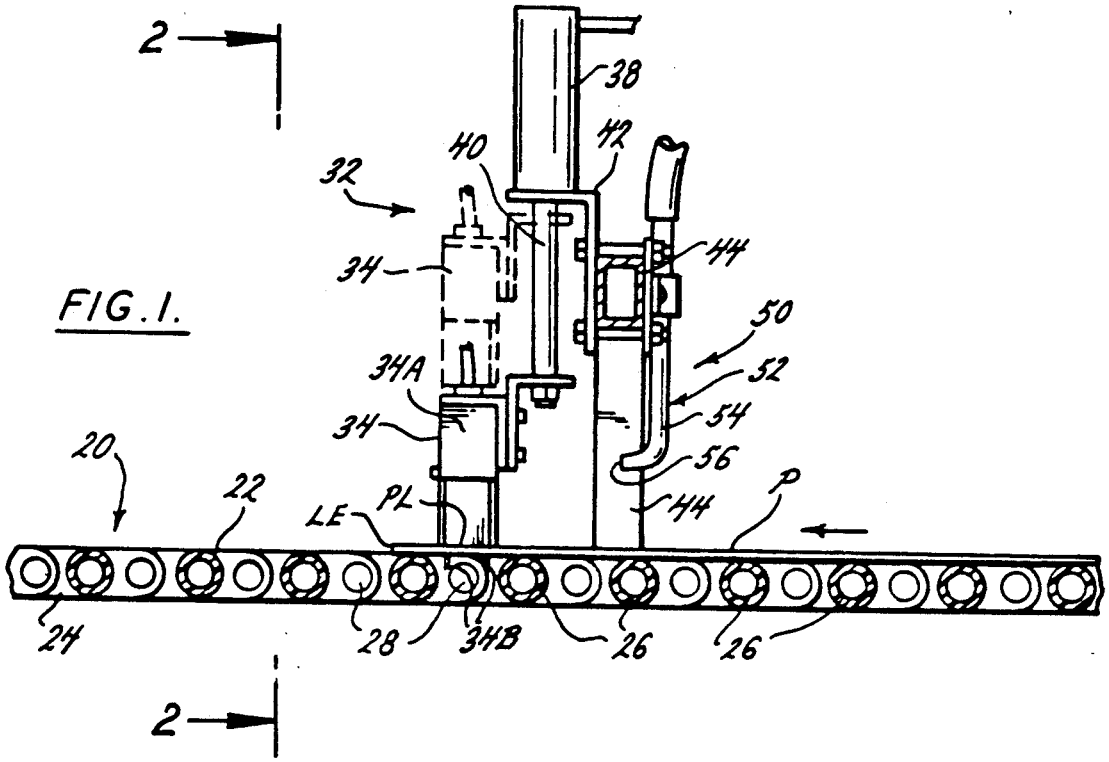
FIG. 1 is a side elevation of the apparatus of a first embodiment of the present invention showing pick-up means in its grasping position (solid lines) and in its raised position (in phantom)

Referring to the drawings, apparatus of this invention for automatically inverting a workpiece of limp sheet material, such as plies P of fabric sheet material, is shown to comprise an endless conveyor 20 having a forward-traveling upper reach 22 for conveying plies in a forward direction (from right to left as viewed in FIG. 1). Although the apparatus is particularly adapted for turning over plies of fabric, it is contemplated that its principles are applicable to apparatus for inverting other workpieces of limp sheet material. Only the portion of the upper reach 22 of the conveyor necessary for an understanding of the present invention has been illustrated in the drawings. The conveyor 20 is substantially the same as the conveyor disclosed in my co-pending, co-assigned application Ser. No. 07/445,539, filed Dec. 4, 1989, which is incorporated herein by reference. Briefly described, the conveyor 20 comprises a pair of endless chains 24 which are driven by suitable means (such as motor 25 shown in Ser. No. 445,539). The surface of the conveyor 20 is made up of rods 26 extending transversely with respect to the chains 24 of the conveyor. The chains 24 have pins 28 extending inwardly from the inside of the chains (see FIGS. 1 and 2). The rods 26 are tubular flexible plastic rods (e.g. nylon rods) each mounted at its ends on two of these pins 28 which extend inwardly from the left and right hand chains 24 in axial alignment with each other. Each rod 26 is mounted on its respective pair of pins 28 by bending it to fit between the inner ends of the pins and then allowing it to straighten out and slip onto the pins. As will be explained more fully below, particularly in regard to the apparatus of the first embodiment, other types of conveyors may also be used in the apparatus and fall within the scope of the present invention.

Figure 2:
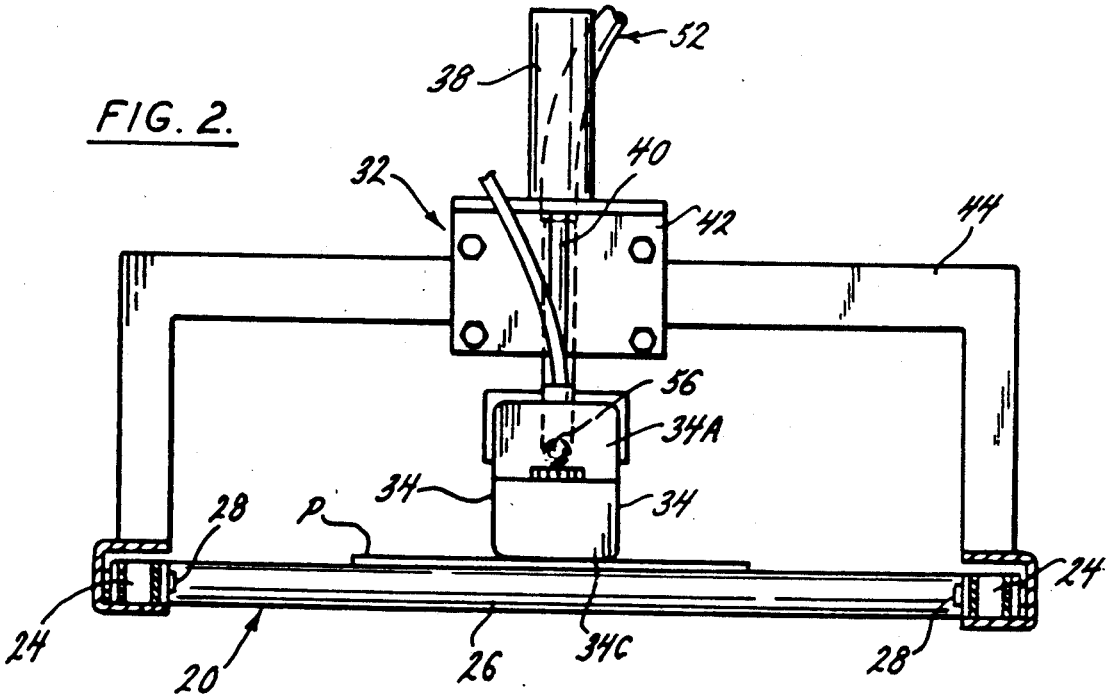
FIG. 2 is a section of the apparatus taken in the plane including line 2–2 of FIG. 1.

Pick-up means indicated generally at 32 is provided for grasping a portion of the workpiece or "ply" P adjacent its leading edge LE as the workpiece travels forward on the conveyor. In the preferred embodiments, the pick-up means 32 includes a fabric gripper 34 manufactured by Arato Engineering of Switzerland and made available in the United States by E & E Engineering, Inc. of Detroit, Mich. Briefly described, the gripper has a body 34A which houses a plurality of steel needles 34B (see FIG. 3) which are selectively extensible by the application of air pressure from a gripping face 34C on the lower end of the body. When the needles 34B are extended, they project downwardly from the gripping face 34C at angles oblique to the vertical (some of the needles are angled in laterally opposite directions such that they cross each other, thus providing the gripping action). In use, the gripping face 34C is engaged with the ply P and the needles 34B are extended to pierce and grip the ply. The pick-up means 32 further includes an air cylinder 38 having an extensible and retractable rod 40. As shown in FIGS. 1 and 2, the cylinder 38 is mounted by a bracket 42 on a support 44 extending transversely over the conveyor 20, and the gripper 34 is mounted on the rod 40 for motion downward from its raised position (shown in phantom in FIG. 1) to grasp a leading edge portion PL of the ply P, and upward to lift the leading edge portion off the conveyor 20.

Figure 3:
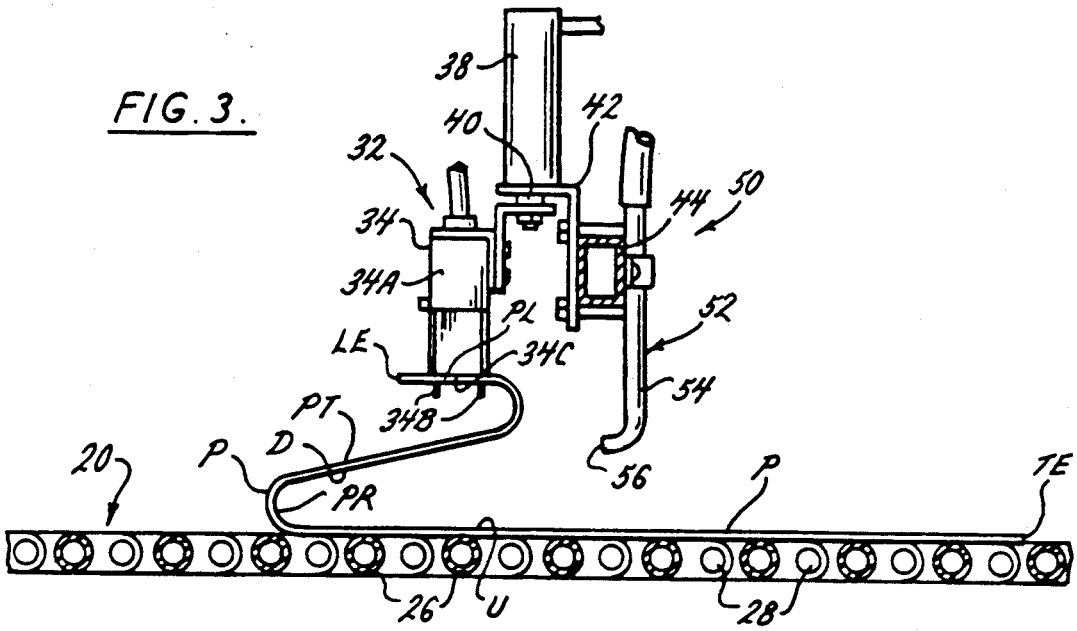
FIGS. 3–5 illustrate inversion of a workpiece of limp sheet material by the apparatus of the first embodiment.
Figure 6:
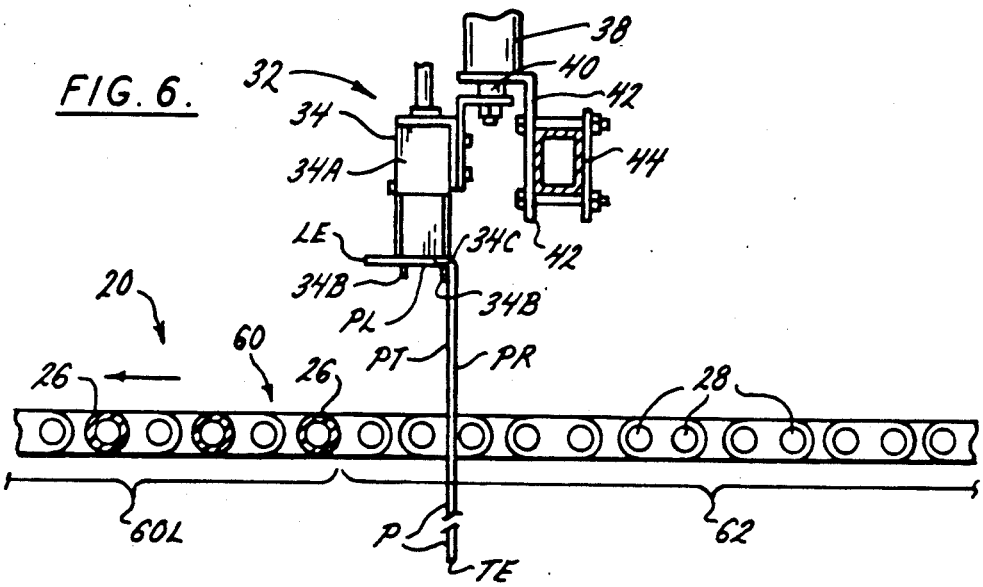
FIGS. 6–8 illustrate inversion of a workpiece of limp sheet material by apparatus of a second embodiment.
Figure 7:
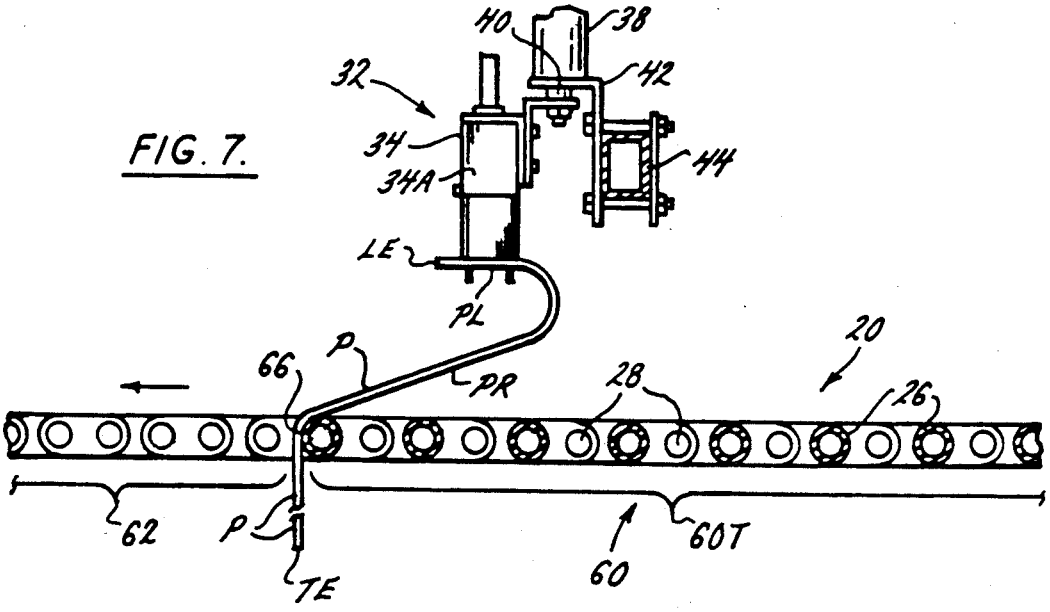

As shown in FIGS. 3 and 6, when the leading edge portion PL of the ply P is lifted off the conveyor 20 and held in the raised position by the pick-up means 32, a trailing portion PT of the ply P extends downwardly from the gripper 34 and contacts the conveyor. Thus, the trailing portion PT tends to move forwardly on the conveyor 20 beneath the leading edge portion PL, toward an inverted position (FIGS. 2 and 7). Although continued forward movement of the trailing portion PT (as the leading edge portion PL is held stationary) tends to turn over the trailing portion PT, this frequently does not result in complete inversion of the workpiece. For instance, as the trailing portion PT is carried forward from the position shown in FIG. 3, the generally downwardly facing surface D of an upper part of the ply will come into contact with the upwardly facing surface U of a lower portion of the ply. The frictional force between engaging surfaces D and U of the ply is often greater than the frictional force between the ply and the conveyor 20. Therefore, rather than turning over, the trailing edge TE of the ply remains folded under the forwardmost portion of the ply. This is entirely unsuitable for further operations, such as sewing, which require that the sheet of material lie unfolded and substantially flat on the conveyor 20.

Figure 5:
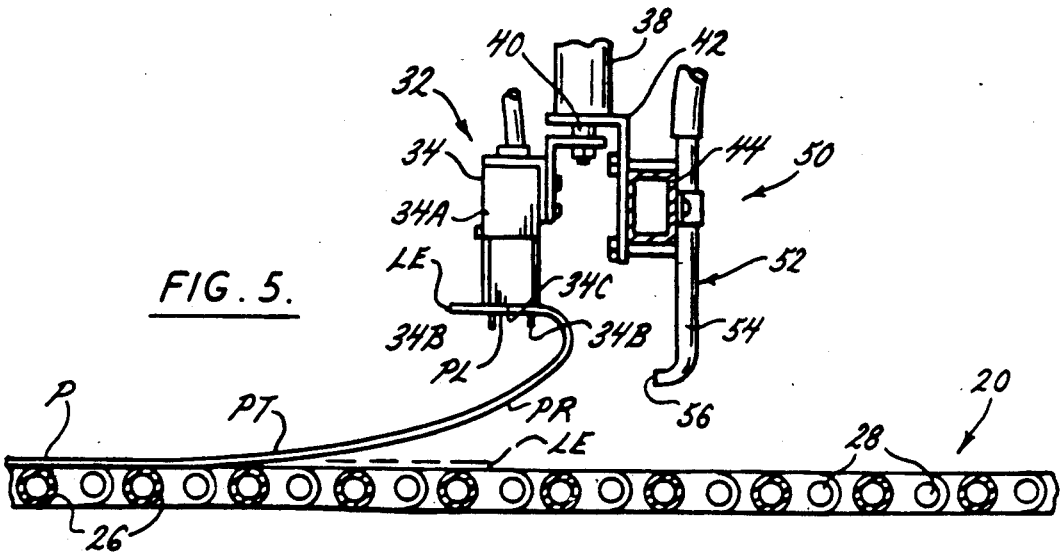
Figure 9:
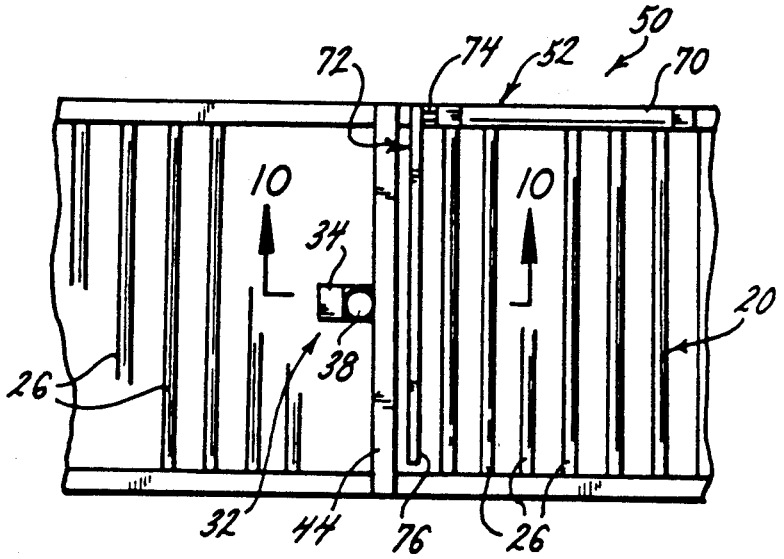
FIG. 9 is a plan view of apparatus of a third embodiment with portions broken away to show detail.
Figure 11:
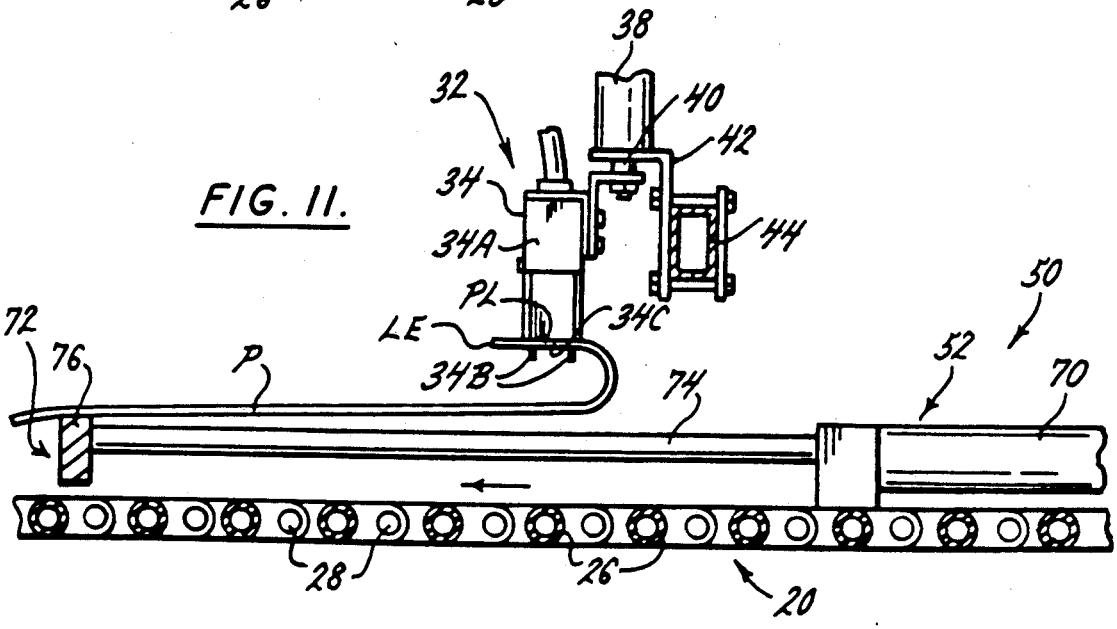

In accordance with this invention, pusher means, generally indicated at 50, is provided for acting on a generally rearwardly facing surface PR of the trailing portion PT of the ply P, and for pushing the trailing portion forwardly to complete the inversion of the trailing portion as the leading edge portion PL is held stationary by the pick-up means 32. The three embodiments of the invention, which are discussed separately below, incorporate three forms of pusher means 50. The inverted position of the trailing portion PT is shown in FIGS. 5, 9 and 11. After the trailing portion PT has been inverted, the gripper 34 is adapted to release the leading edge portion PL of the ply from its raised position, with the leading edge LE of the ply dropping to the conveyor 20 as the remaining portions of the ply continue to move forwardly on the conveyor. The ply is thus completely inverted and in a position with its leading edge LE rearward of its trailing edge TE, as shown in phantom in FIG. 5.

Referring now to FIGS. 1–5, apparatus of the first embodiment of the present invention is shown. The apparatus includes the conveyor 20 and pick-up means 32 substantially as described above. However, the conveyor 20 need not comprise flexible rods 26 mounted on endless chains 24 as described above, but could also, for instance, comprise an endless conveyor belt mounted on rollers. As shown in FIG. 1, the workpiece or "ply" P is supported on the conveyor 20 rearwardly of the pick-up means 32 with its leading edge LE defining the forwardmost (relative to the direction of travel of the ply) extent of the ply and its trailing edge TE defining the rearwardmost extent of the ply. As the leading edge LE moves under the gripper 34, the cylinder 38 is activated to extend its rod 40 downwardly such that the gripping face 34C of the gripper engages or is closely adjacent the leading edge portion PL of the ply (FIGS. 1 and 2). The needles 34B of the gripper are extended to grasp the leading edge portion PL and the cylinder 38 retracts its rod 40, lifting the gripper 34 and the leading edge portion PL off the conveyor 20 (FIG. 3).

Figure 4:
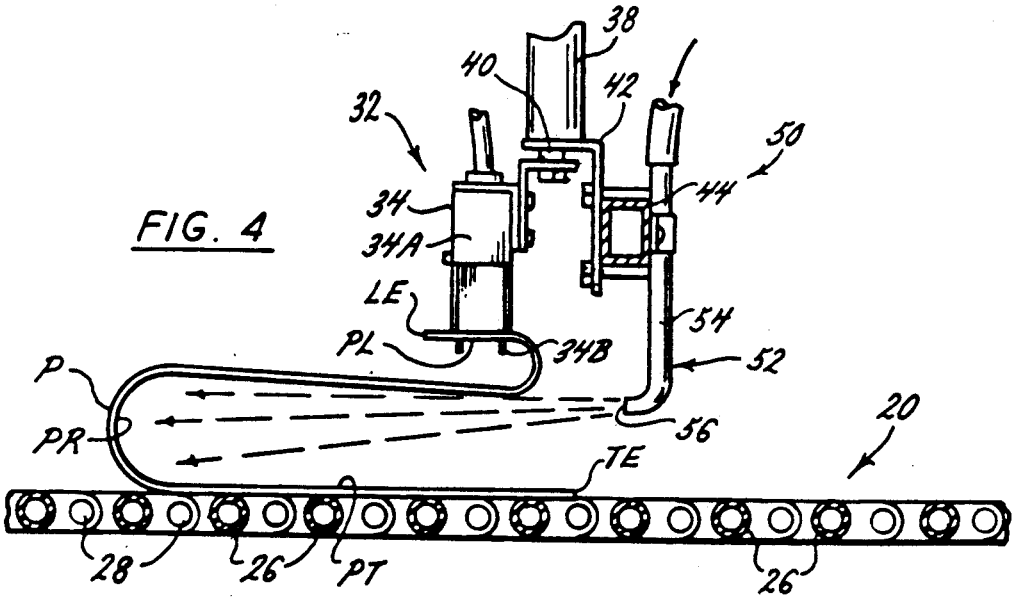

In the first embodiment, the pusher means 50 comprises impulse means 52 including a conduit 54 having an outlet 56 positioned rearwardly of the gripper 34. The conduit 54 is mounted on the support 44 and delivers compressed air from a source of compressed air (shown schematically in FIG. 12). The conduit 54 is adapted to direct a burst of air from the outlet 56 forward against the generally rearwardly facing surface PR of the ply, as illustrated in FIG. 4. The trailing portion PT is pushed forward over the conveyor 20 by the blast of air at a significantly higher speed than the forward rate of travel of the conveyor itself. Therefore, the trailing portion PT of the ply is completely inverted with the trailing edge TE now leading the remaining portions of the ply (FIG. 5). The leading edge portion PL of the ply is then released to drop back to the conveyor 20 in the manner stated above.

Figure 8:
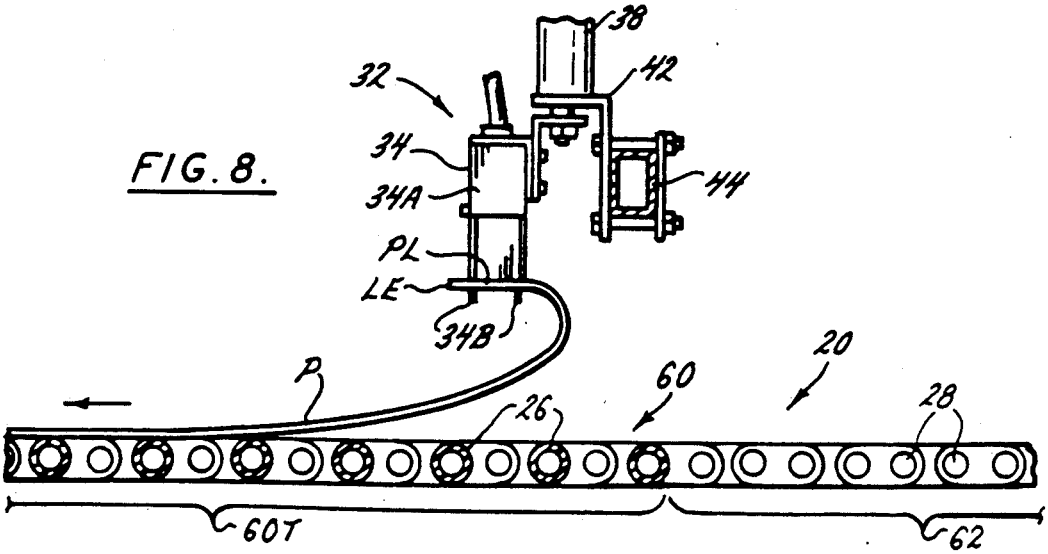

A second embodiment of the present invention is shown in FIGS. 6–8. The apparatus of the second embodiment includes the pick-up means 32, exactly as described above. However, the conveyor 20 is made up of a series of flights 60 spaced at intervals with openings 62 between the flights. The conveyor 20 of the first embodiment may be changed to this configuration by removing several of the flexible rods 26 from the chains 24 at regular intervals to define the flights 60 and openings 62. Each flight 60 is constructed for carrying the workpiece or "ply" P on it with the leading edge LE of the ply generally at the opening 62 which leads the flight and its trailing edge TE rearward of the opening leading the flight.

In the second embodiment, the leading edge portion PL of the ply P is grasped and lifted off the conveyor flight 60 as described above and shown in FIG. 3 with respect to the first embodiment of the apparatus. Although the trailing portion PT initially moves forward beneath the leading edge LE of the ply, the gripper 34 restricts the forward motion of the trailing portion. Therefore, as the flight 60 advances forwardly the trailing edge TE and part of the trailing portion PT fall through an opening 62 between a leading flight 60L (i.e., the flight 60 which initially supports the ply) and a trailing flight 60T (i.e., the flight 60 which trails the flight initially supporting the ply) rearward of the leading flight. In that position, the ply is supported solely by and hangs freely down from the gripper 34, as shown in FIG. 6. The pusher means 50 in the second embodiment comprises a leading surface 66 of the trailing flight 60T (that is, the forward edge of the leading rod in the trailing flight 60T). The leading surface 66 engages the generally rearwardly facing surface PR of the trailing portion, pushing the trailing portion forwardly (FIG. 7). The gripper 34 continues to hold the leading edge portion PL of the ply stationary such that the trailing portion PT moves under and forward of the leading edge LE (FIG. 8), to complete the inversion of the trailing portion. At approximately the time the trailing flight 60T has moved under the trailing edge TE of the ply such that the trailing edge is located on top of the trailing flight, the gripper 34 releases the leading edge portion PL, allowing the leading edge LE of the ply to drop to the trailing flight in a position rearward of the trailing edge and with the ply completely inverted.

Figure 10:
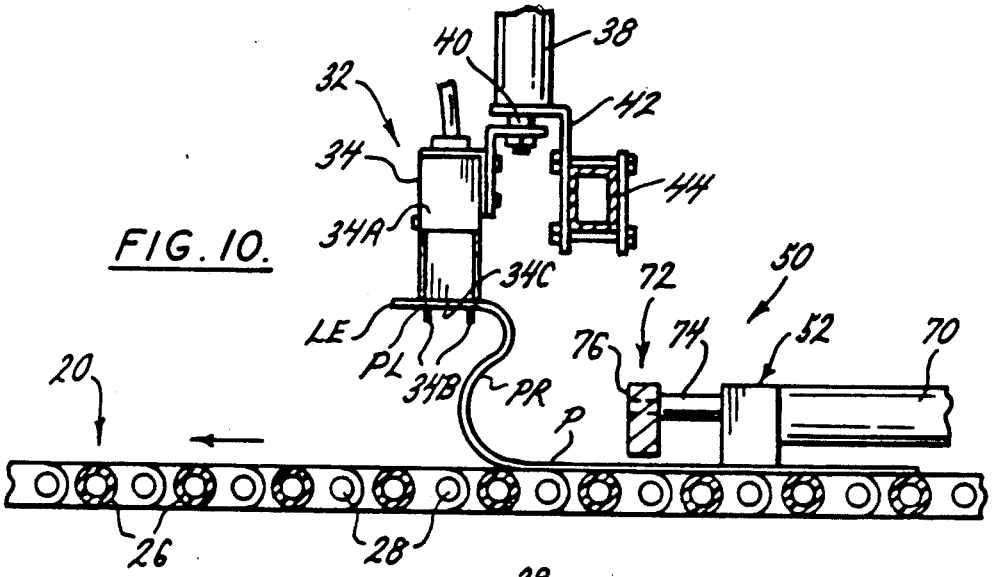
FIGS. 10–11 illustrate inversion of a workpiece of limp sheet material by the apparatus of the third embodiment.

Referring now to FIGS. 9–11, apparatus of a third embodiment is shown to comprise an endless conveyor 20 and pick-up means 32 exactly as described above for the first embodiment. However, in this embodiment, the pusher means 50 comprises an air cylinder 70 with an extensible and retractable ram 72 (broadly "impulse means 52"). The cylinder 70 is disposed above the conveyor 20 and to one side thereof with its longitudinal extension parallel to the direction of travel of the conveyor. The ram 72 includes a rod 74 and a pusher bar 76 extending generally transversely across the conveyor 20. The pusher bar 76 is vertically separated from the conveyor 20 by a relatively small distance. As in the previous embodiments, the initial operation of the apparatus involves grasping the leading edge portion PL of the ply with the gripper 34 and lifting the leading edge portion up so that the ply assumes the position shown in FIG. 10. Thereafter, the cylinder 70 is activated to rapidly extend the ram 72 at a significantly greater rate than the rate of travel of the conveyor 20. The pusher bar 76 engages the generally rearwardly facing surface PR of the trailing portion and pushes the trailing portion forwardly underneath the leading edge LE for completely inverting the trailing portion PT (FIG. 11). The rod 74, in its extended position, projects forward of the pick-up means 32 nearly the length of the trailing portion PT of the ply so that the trailing portion is fully inverted by the ram 72. The ram 72 is then retracted to its former position rearward of the pick-up means 32, and the leading edge portion PL is dropped by the gripper 34 as previously described to complete the inversion of the ply.

Figure 12:
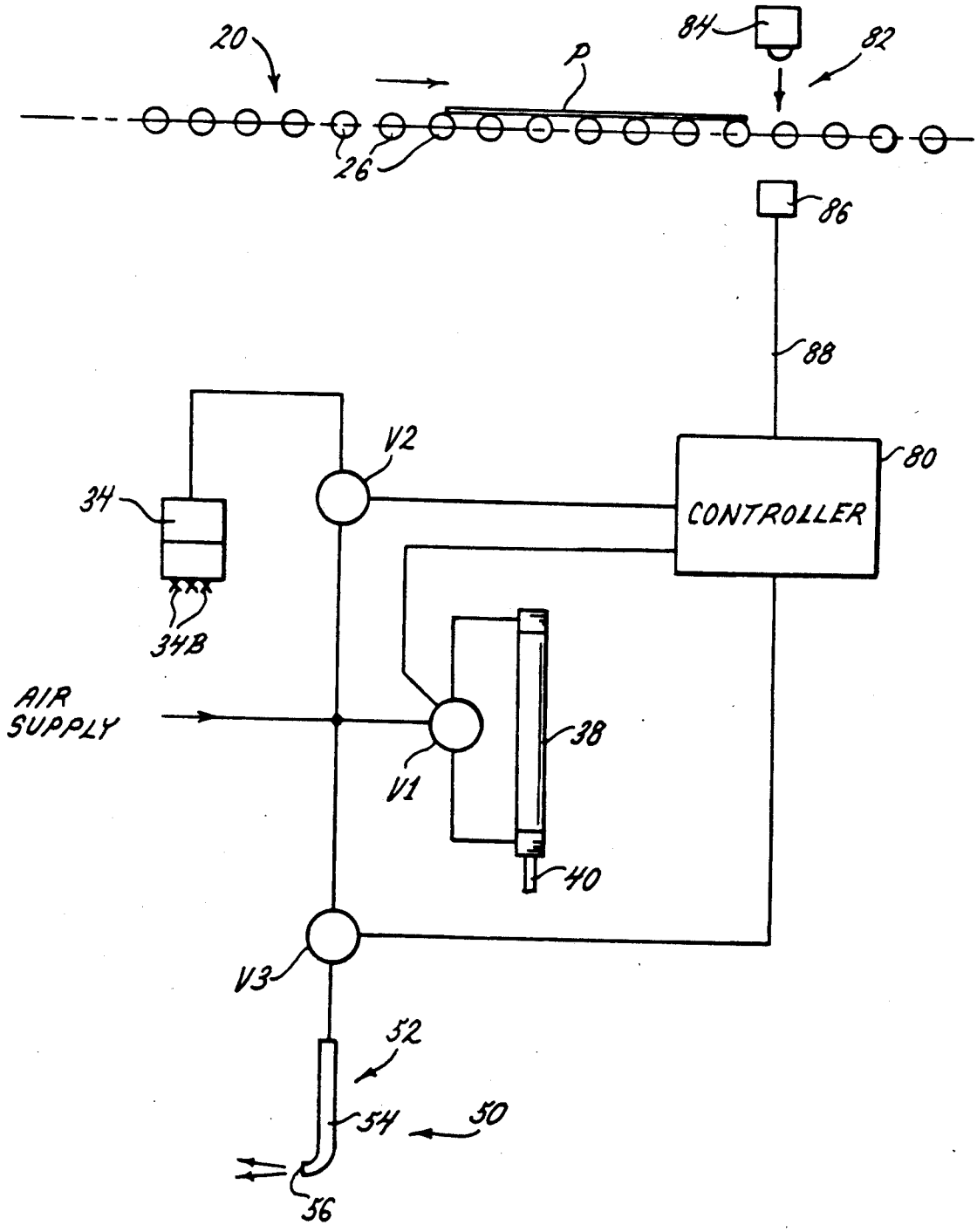
FIG. 12 is a diagramatic view illustrating circuitry of the apparatus.

The apparatus is under control of a programmable controller, such as indicated at 80 in FIG. 12, which may be a Shark X-903 controller sold by Reliance Electric Corp. through their dealers in major cities. In the first embodiment of the present invention, the controller controls the valve V1 for the air cylinder 38, the valve V2 for the gripper 34, and the valve V3 for the impulse means 52. In the apparatus of the second embodiment, the controller 80 similarly controls the air cylinder 38 and gripper 34; there is no impulse means 52, and thus no valve for controlling the same. At 82 is indicated means for sensing the passage of a ply P over a point rearward of the pick-up means 32, this means being an electric eye means having a light source 84 which projects a beam of light toward the upper reach 22 of the conveyor, the beam impinging on an electric eye 86 except when a ply passes between the light source and eye. The eye means 82 is of the type having a built-in delay so that it is not activated by the passage of the rods 26 making up the conveyor 20 (or conveyor flights 60) through the beam. Another type of commercially available sensing means may be employed where the conveyor is opaque. The eye means 82 is activated by passage of the trailing edge TE of the ply such that a beam of light from light source 84 again impinges upon the electric eye 86 which then transmits a signal to the controller 80 over a line 88 to initiate a cycle of operation of the pick-up means 32. Under control of the controller 80 the valve V1 for the air cylinder 38 is activated to actuate the cylinder to extend the rod 40 downward from its raised position (shown in phantom in FIG. 1), bringing the gripping face 34C of the gripper 34 into engagement with the leading edge portion PL of the ply (as shown in solid lines in FIG. 1). Valve V2 is then activated to actuate the gripper 34 to extend the needles 34B from the gripper body 34A to grasp the ply, and valve V1 is reactivated to actuate the cylinder 38 to lift the gripper and the leading edge portion PL off the conveyor 20 (FIG. 3). The impulse means 52 discharges its blast of air against the generally rearwardly facing surface PR of the trailing portion PT of the ply by activation of the valve V3 by the controller 80 (FIG. 4). After the discharge of a burst of air by the impulse means 52, the valve V2 is reactivated to retract the needles 34B into the gripper body 34A, releasing the leading edge portion PL which drops to the conveyor 20. The ply P is thus inverted with the leading edge LE rearward of the trailing edge TE. The control of the impulse means 52 and the release of the leading edge portion PL by the gripper 34 is on a time basis. However, the initial downward and grasping movement of the pick-up means 32 is set to occur immediately after the controller 80 receives the signal from the eye means 82. Therefore, it is necessary initially to position the eye means 82 relative to the pick-up means 32 so that the gripper 34 will engage the leading edge portion PL of the ply.

The cycle of operation for the apparatus of the second embodiment, with the exception of the operation of impulse means 52 which is not present in the second embodiment, is the same as for the first embodiment. The circuitry of the apparatus of the third embodiment is more nearly like that of the first embodiment. It differs only in that the impulse means 52 comprises the air cylinder 70 and ram 72; however, the timing of the air blast from conduit 54 and the rapid extension of the ram from the air cylinder 70 is the same.

The apparatus of the present invention is particularly suited for use in the apparel industry, such as in the application described in the Background of the Invention. As stated, a stack of workpieces or "plies" P are cut from a fan-folded spread (not shown) such that adjacent plies in the stack alternate having the outer and inner surface of the fabric facing upwardly. The plies in the stack are individually fed onto the conveyor 20, such as by a feeder of the type disclosed in application Ser. No. 07/445,539. It is necessary for the conduct of manufacturing operations on the plies that all of them be oriented with the same surface of the fabric facing upward. In other words, every other ply in the stack cut from the fan-folded spread needs to be inverted. To that end, the controller 80 of the present invention may be set by the operator to invert every other workpiece. The controller 80 is equipped with a flip-flop circuit of the kind available in standard controllers so that a cycle of operation is not activated until after every second interruption of the beam by passage of a ply between the light source 84 and the electric eye 86.

It will be observed that, once the left and right workpieces or "plies" P have been individually fed onto the upper reach 22 of the conveyor, plies are automatically and efficiently inverted by the apparatus of the present invention as they travel along on the conveyor 20. The provision of the pusher means 50, in its various embodiments set forth above, completely inverts the Ply so that it lies flat on the conveyor 20 in its inverted position. The pusher means 50 drives the trailing portion PT of the ply forward such that an edge (e.g., the trailing edge TE) of the ply is not allowed to fold under the ply which would cause incomplete inversion of the ply.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for automatically inverting workpieces of limp sheet material, such as fabric sheet material, the apparatus comprising, an endless conveyor having a forward-traveling upper reach for conveying workpieces in a forward direction, each workpiece having a leading edge and a trailing edge, pick-up means for grasping a portion of the workpiece adjacent its leading edge as the workpiece travels on the conveyor, lifting said leading edge portion of the workpiece off the conveyor and holding said leading edge portion stationary with a trailing portion of the workpiece extending downwardly from said pick-up means, said trailing portion contacting the conveyor and tending to move forwardly thereon beneath said leading edge portion toward an inverted position, pusher means adapted to act on a surface of said trailing portion of the workpiece facing generally rearwardly for pushing said trailing portion of the workpiece forwardly to complete the inversion of said trailing portion as said leading edge portion is held stationary by said pick-up means, said pick-up means being adapted to release said leading edge portion of the workpiece after said trailing portion of the workpiece has been inverted whereupon said leading edge of the workpiece is adapted to drop to the conveyor with the workpiece inverted and in a position wherein said leading edge is rearward of said trailing edge.

2. Apparatus as set forth in claim 1 wherein said pusher means comprises means for applying an impulse to the generally rearwardly facing surface of said trailing portion.

3. Apparatus as set forth in claim 2 wherein said impulse applying means comprises a conduit having an outlet positioned rearwardly of said pick-up means, said conduit being adapted to direct a burst of compressed air from the outlet forward against the rearwardly facing surface of said trailing portion of the workpiece.

4. Apparatus as set forth in claim 2 wherein said impulse means comprises a ram adapted to extend forward more rapidly than the rate of travel of the conveyor to engage the generally rearwardly facing surface of said trailing portion of the workpiece.

5. Apparatus as set forth in claim 4 wherein the ram comprises a pusher bar extending generally transversely across the conveyor, the pusher bar being vertically closely spaced above the conveyor.

6. Apparatus as set forth in claim 1 wherein the conveyor comprises a series of flights spaced at intervals therealong with openings between the flights, said trailing edge and part of said trailing portion of the workpiece being adapted to drop through an opening between a leading flight and a trailing flight after said pick-up means has grasped and lifted said leading edge portion of the workpiece, said pusher means comprising a leading surface of said trailing flight of the conveyor, said leading surface being engageable with said generally rearwardly facing surface of said trailing portion of the workpiece as the conveyor moves forwardly to push said trailing portion forwardly thereby completely inverting said trailing portion.

7. Apparatus as set forth in claim 1 wherein said pick-up means comprises gripper means and a cylinder, the cylinder being mounted on support means extending generally transversely over the conveyor, said gripper means being mounted on an extensible and retractable rod of the cylinder for motion downwardly to grasp said leading edge portion and upwardly for lifting said leading edge portion off the conveyor.

8. Apparatus as set forth in claim 1 further comprising means for sensing the passage of a workpiece over a point rearward of said pick-up means and activating said pick-up means on the passage of each workpiece over the point.

9. Apparatus as set forth in claim 1 further comprising means for sensing the passage of a workpiece over a point rearward of said pick-up means and activating said pick-up means on the passage of every other workpiece over the point.

10. Apparatus for automatically inverting workpieces of limp sheet material, such as fabric sheet material, the apparatus comprising, an endless conveyor having a forward-traveling upper reach for conveying workpieces in a forward direction, each workpiece having a leading edge and a trailing edge, pick-up means for grasping a portion of the workpiece adjacent its leading edge as the workpiece travels on the conveyor, lifting said leading edge portion of the workpiece off the conveyor and holding said leading edge portion stationary with a trailing portion of the workpiece extending downwardly from said pick-up means, said trailing portion contacting the conveyor and tending to move forwardly thereon beneath said leading edge portion toward an inverted position, impulse applying means for applying an impulse to a generally rearwardly facing surface of said trailing portion to push said trailing portion forwardly over the upper reach of the conveyor to effect complete inversion of said trailing portion as said leading edge portion is held stationary by said pick-up means, said pick-up means being adapted to release said leading edge portion of the workpiece after said trailing portion of the workpiece has been inverted whereupon said leading edge of the workpiece is adapted to drop to the conveyor with the workpiece inverted and in a position wherein said leading edge is rearward of said trailing edge.

11. Apparatus as set forth in claim 10 wherein said impulse means comprises a conduit having an outlet positioned rearwardly of said pick-up means, said conduit being adapted to direct a burst of compressed air from the outlet forward against the rearwardly facing surface of said trailing portion of the workpiece.

12. Apparatus as set forth in claim 10 wherein said impulse means comprises a ram adapted to extend forward more rapidly than the rate of travel of the conveyor to engage the generally rearwardly facing surface of said trailing portion of the workpiece.

13. Apparatus as set forth in claim 12 wherein the ram comprises a pusher bar extending generally transversely across the conveyor, the pusher bar being vertically closely spaced above the conveyor.

14. Apparatus as set forth in claim 10 wherein said pick-up means comprises gripper means and a cylinder, the cylinder being mounted on support means extending generally transversely over the conveyor, said gripper means being mounted on an extensible and retractable rod of the cylinder for motion downwardly to grasp said leading edge portion and upwardly for lifting said leading edge portion off the conveyor.

15. Apparatus as set forth in claim 10 further comprising means for sensing the passage of a workpiece over a point rearward of said pick-up means and activating said pick-up means on the passage of each workpiece over the point.

16. Apparatus as set forth in claim 10 further comprising means for sensing the passage of a workpiece over a point rearward of said pick-up means and activating said pick-up means on the passage of every other workpiece over the point.

17. Apparatus for automatically inverting workpieces of limp sheet material, such as fabric sheet material, the apparatus comprising, an endless conveyor having a forward-traveling upper reach for conveying workpieces, the conveyor having a series of flights spaced at intervals therealong with openings between the flights;

each flight being constructed for carrying a workpiece thereon with the workpiece lying on the flight and having a leading edge generally adjacent that opening which leads the flight and a trailing edge rearward of the opening which leads the flight, pick-up means for grasping a portion of the workpiece adjacent its leading edge as the workpiece travels on the conveyor, and lifting said leading edge portion of the workpiece off the conveyor with a trailing portion of the workpiece extending generally downwardly from said leading edge portion, said trailing edge and part of said trailing portion of the workpiece being adapted to drop through an opening between a leading flight and a trailing flight after said pick-up means has grasped and lifted said leading edge portion of the workpiece, pusher means comprising a leading surface of said trailing flight engageable with a generally rearwardly facing surface of said trailing portion as the conveyor moves forwardly to push said trailing portion forwardly thereby completely inverting said trailing portion, said pick-up means being adapted to release said leading edge portion of the workpiece after said trailing portion of the workpiece has been inverted whereupon said leading edge of the workpiece is adapted to drop to the conveyor with the workpiece inverted and in a position wherein said leading edge is rearward of said trailing edge.

18. Apparatus as set forth in claim 17 wherein said pick-up means comprises gripper means and a cylinder, the cylinder being mounted on support means extending generally transversely over the conveyor, said gripper means being mounted on a rod of the cylinder for motion downwardly to grasp said leading edge portion and upwardly for lifting said leading edge portion off the conveyor.

19. Apparatus as set forth in claim 17 further comprising means for sensing the passage of a workpiece over a point rearward of said pick-up means and activating said pick-up means on the passage of each workpiece over the point.

20. Apparatus as set forth in claim 17 further comprising means for sensing the passage of a workpiece over a point rearward of said pick-up means and activating said pick-up means on the passage of every other workpiece over the point.

* * * * *